United States Patent [19]

Dameron

[11] Patent Number: 4,779,910

[45] Date of Patent: Oct. 25, 1988

[54] SELF-RELEASING SECURITY BAR

[75] Inventor: Rodger S. Dameron, Midland, Tex.

[73] Assignee: Dameron Manufacturing Corp., Midland, Tex.

[21] Appl. No.: 10,849

[22] Filed: Feb. 4, 1987

[51] Int. Cl.[4] ..... E05C 21/02; E05C 9/04

[52] U.S. Cl. ..... 292/259 R; 292/263; 292/DIG. 65

[58] Field of Search ..... 292/259, 338, 305, 260, 292/263, 268, 270, DIG. 46, DIG. 65, 42, 32

[56] References Cited

U.S. PATENT DOCUMENTS

| | | | |
|---|---|---|---|
| 386,423 | 7/1888 | Cornell | 292/259 |
| 1,553,003 | 9/1925 | Ohmart | 292/263 |
| 2,421,275 | 5/1947 | Lopez | 292/259 |
| 3,583,743 | 6/1971 | Newell | 292/339 |
| 3,752,518 | 8/1973 | Cannell | 292/42 |
| 3,809,417 | 5/1974 | Craig | 292/259 |
| 3,986,741 | 10/1976 | Giovannini | 292/259 R |
| 4,017,104 | 4/1977 | Walker | 292/259 R |
| 4,070,049 | 1/1978 | Brewer | 292/338 |
| 4,078,836 | 3/1978 | Wilson | 292/338 |
| 4,262,503 | 4/1981 | Kuebler | 292/259 R |
| 4,295,676 | 10/1981 | Smith | 292/DIG. 46 |
| 4,318,559 | 3/1982 | Burton | 292/263 |
| 4,462,625 | 7/1984 | Barnhill | 292/259 R |
| 4,483,558 | 11/1984 | Van Meter | 292/339 |
| 4,563,027 | 1/1986 | Chechovsky et al. | 292/339 |

*Primary Examiner*—Gary L. Smith
*Assistant Examiner*—Eric K. Nicholson
*Attorney, Agent, or Firm*—John A. Waters

[57] ABSTRACT

A security bar maintaining the closure of a hinged door has telescoping inner and outer sections, with the opposite ends of this assembly engaging receptacles in a door jamb or the wall structure adjacent the door opening. Aligned transverse holes in the inner and outer sections are engaged by a release pin to maintain the bar in engagement with the receptacles to prevent unauthorized opening of the door. A spring pulls the bar sections to a shorter overall length on removal of the release pin to permit the bar to fall away from the receptacles for emergency exit.

8 Claims, 3 Drawing Sheets

SELF-RELEASING SECURITY BAR

BACKGROUND OF THE INVENTION

Hinged doors are commonly barred closed for security reasons. The presence of the bar extending across the door opening prevents the door from swinging open under forces applied from the opposite side of the door. The usual arrangement includes receptacles mounted on the door jamb, or adjacent wall structure, at or slightly above the height of the door handle. These receptacles are engaged by a solid or telescoping bar. Solid bars have to be lifted out of hook-shaped receptacles, and the telescoping bars may have internal compression springs biasing the bar sections to increased overall length to keep them in engagement with the receptacles. A cross-pin usually engages aligned holes in the bar sections to reinforce the effect of the spring. Release is obtained by pulling the pin, and then pulling the bar sections to decreased length against the spring action, so that the bar can be disengaged from the receptacles.

In case of fire or other emergency, it becomes necessary to release the door immediately, often under panic conditions. People cannot then be counted upon to act with calm logic, and complications involved in the forcible disengagement of a security bar may be too much to handle.

SUMMARY OF THE INVENTION

The present invention provides a self-releasing feature activated by simply pulling the transverse release pin, allowing an internal tension spring to pull the telescoping sections together to a shorter overall length, and permit the bar assembly to disengage from the receptacles and fall away.

DESCRIPTION OF THE PREFERRED EMBODIMENT

Figure 1:
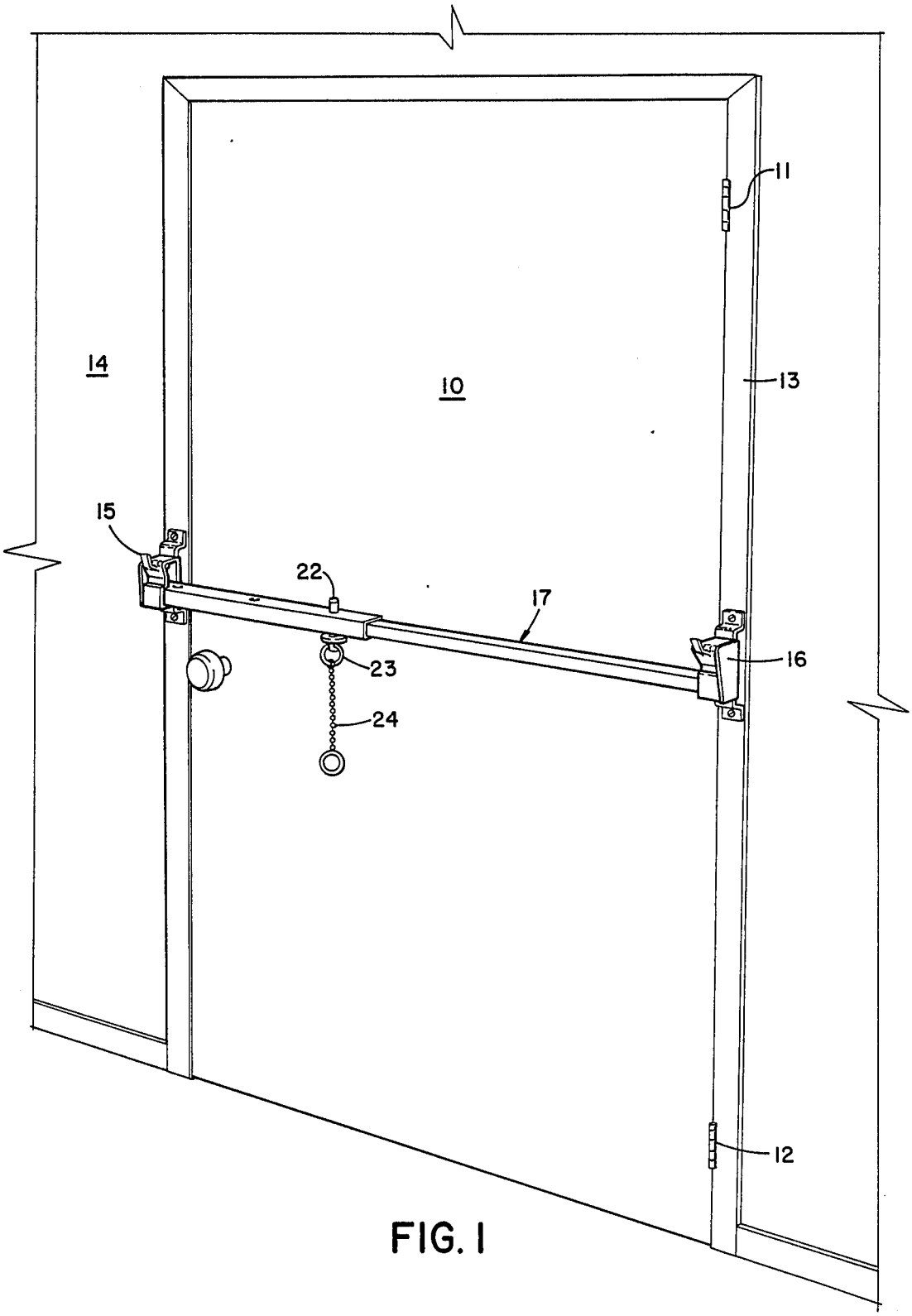
FIG. 1 is a perspective view showing the bar assembly in position to prevent the opening of a hinged door.
Figure 3:
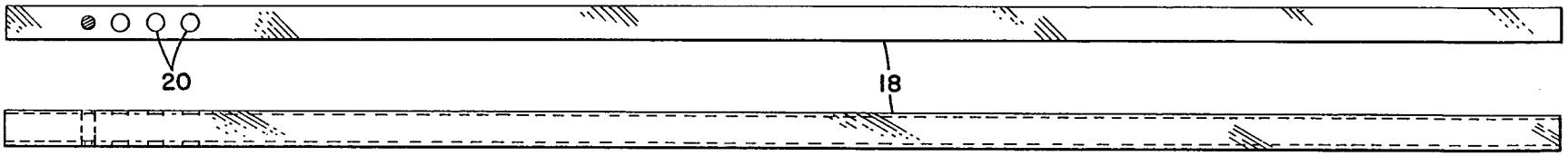
FIG. 3 is a side and top view of the inside bar member.
Figure 2:
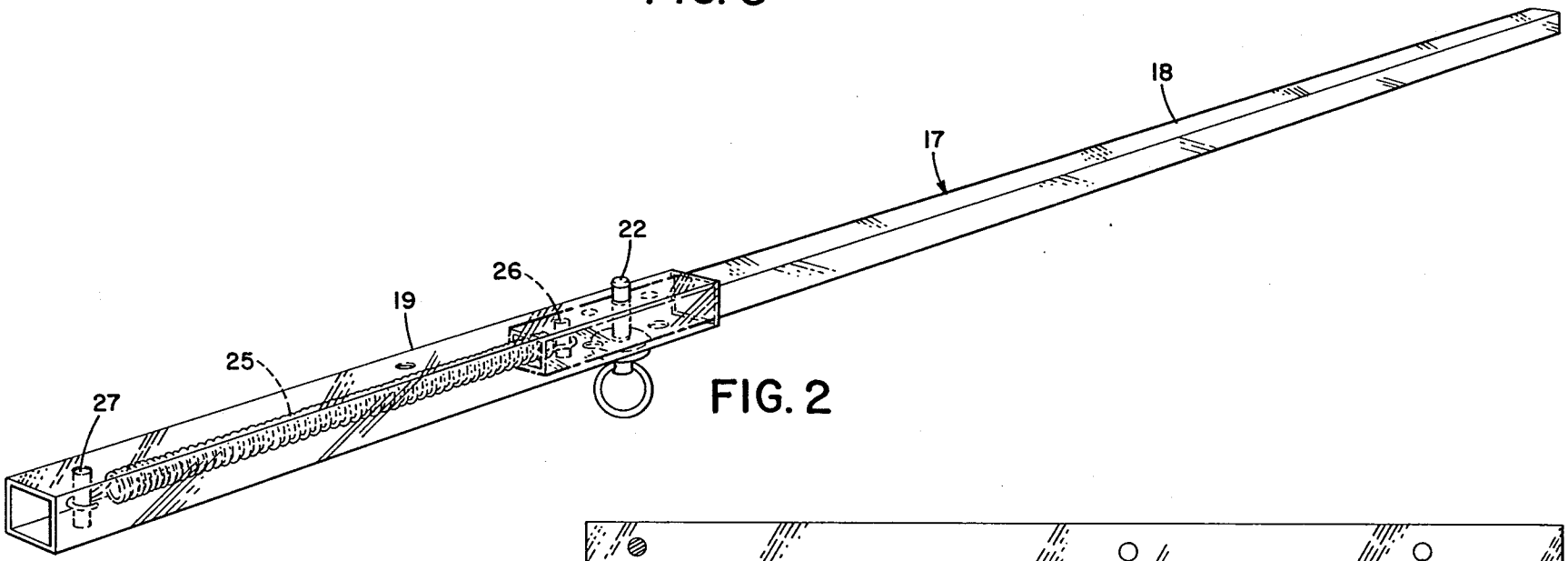
FIG. 2 is a perspective view on an enlarged scale showing the components of the bar assembly.
Figure 4:
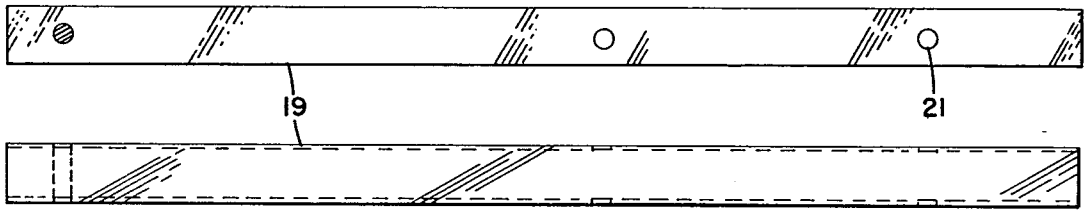
FIG. 4 is a side and top view of the outer bar member.

Referring to FIG. 1, the door 10 is shown hinged at 11 and 12 to the door jamb 13, forming part of the structure of the wall 14. Receptacles as shown at 15 and 16 are secured with screws to opposite sides of the jamb 13 to receive the ends of the bar assembly generally indicated at 17. The bar assembly is best shown in FIG. 2.

Figure 6:
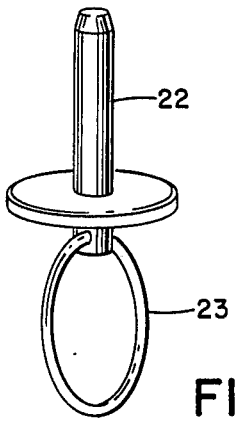
FIG. 6 is a side view of the release pin.
Figure 5:
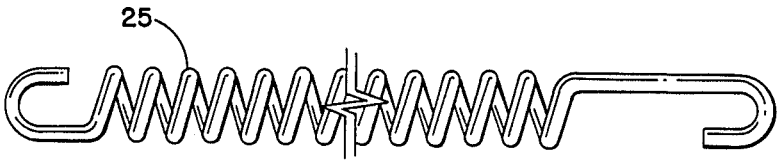
FIG. 5 is a side view of the internal spring.

The bar assembly 17 includes the telescoping inner tube 18 and outer tube 19, which are preferably steel tubes that are generally square in cross-section. Aligned transverse holes as shown at 20 in the inner tube and 21 in the outer tube are adapted to receive a transverse release pin 22, which is shown in FIG. 6. The pin is equipped with a ring 23, which may be engaged directly by a person's finger, or the ring may be provided with a pull chain 24, as shown in FIG. 1. The pin also includes a flange 31 adjacent ring 23 to limit inward movement of the pin in the openings in the tubes. It is preferable that the ring and chain be oriented so that the pull must be downward in order to release the bar assembly, as this direction of applied force tends to facilitate the fall-away action necessary to free the door. Also, the hanging chain and downward release movement facilitates use of the release by a person kneeling or otherwise close to the ground. This makes it easier to release the bar when smoke forces a person to crouch close to the floor or when a person is injured. On release by disengagement of the pin 22, the internal spring 25 induces a relative movement of the inner and outer tubes such as to shorten the overall length, and free the ends of the bar assembly from at least one of the socket receptacles. The spring 25 extends between the terminals 26 in the inner tube and 27 in the outer tube, these terminals being cross-pins welded or brazed at their opposite ends to the respective tubes.

Figure 7:
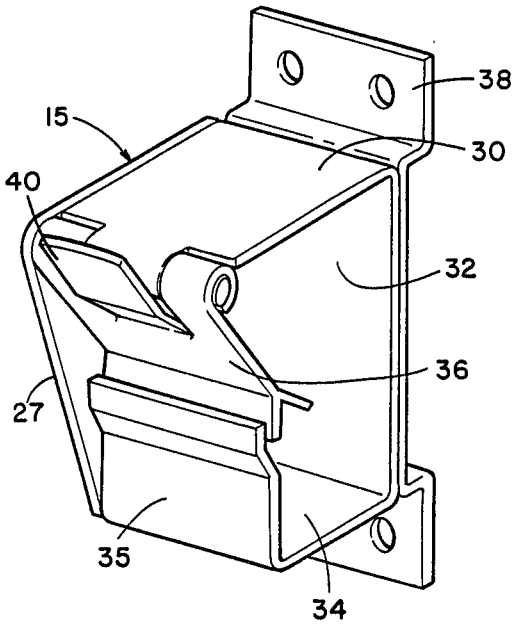
FIG. 7 is a perspective view of the left-hand form of the preferred receptacle used in conjunction with the bar assembly.
Figure 8:
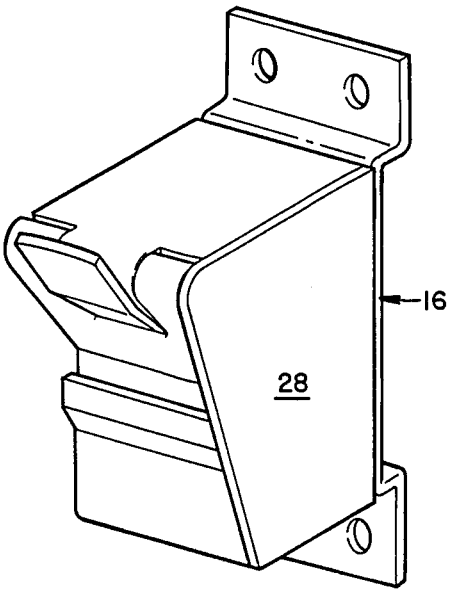
FIG. 8 is a perspective view of the right-hand form of the receptacle illustrated in FIG. 7.

It should be noted that there is a strong possibility that the action of the spring may induce withdrawal of one end of the bar assembly from its associated socket, leaving the other in engagement. With this possibility in mind, it is desirable to form the receptacle sockets with a configuration which permits a substantial angle of declination of the bar assembly from the horizontal as the opposite end is freed. The receptacles, or the surrounding wall structure, should provide a limit to the penetration of the ends of the bar assembly, so that it cannot be accidentally slid in one direction to a sufficient degree to disengage it from one receptacle. This penetration limit is provided by the end panels 27 and 28 of the receptacles shown in FIGS. 7 and 8, the two being identical except for a left-right hand relationship.

The socket-shaped receptacles 15 and 16 preferably are of the type that permit easy insertion of the bar into the receptacle in a sideways direction but resist removal of the bar in the same direction. Each receptacle comprises a rectangular tubular member extending inwardly from end panel 27 or 28. Each tubular member comprises an upper side 30, a back side 32, a bottom side 34, and a front lip 35 extending upwardly from the bottom side at a front edge thereof. A cover plate 36 is pivotally mounted to the upper side at the front edge thereof and extends downwardly to a position behind the front lip. The back side is attached to a mounting plate 38 having flanges with holes therein for attaching the receptacle to a door jamb.

The cover plate pivots inwardly to permit sideways insertion of the safety bar in an extended and pinned condition into the receptacle. The bar then fits down behind the front lip and is restrained thereby from moving inwardly when an attempt is made to open the door inwardly. A Y-shaped flange on the lower end of the cover plate prevents inadvertent opening of the cover plate by the bar. A tab 40 on the top of the cover plate can be pressed down to open the cover plate for sideways removal of the bar assembly.

In operation, the bar is assembled and the pin inserted into the aligned openings in the bar after the bar has been extended to its desired length. The pin is inserted in the bottom of the bar to permit easy removal of the pin simply by yanking the pin down, which is considered a natural reaction in a panic situation. The tension in the spring clamps the pin in the openings in the bar and holds it in place until the pin is manually removed. The bar is then inserted in the receptacles simply by pressing it rearwardly through the cover plate on each receptacle. The bar then remains in place until it is manually removed by opening the cover plate on one of the receptacles or by collapsing the bar by removal of the pin.

The embodiments of the invention in which an exclusive property or privilege is claimed are defined as follows:

1. A security bar system for barring an inwardly pivoting door mounted on a door jamb, the security bar system including receptacles located on opposite sides of said jamb on an inward side of a door and a bar assembly including telescoping inner and outer members extending between the receptacles, the bar assembly having opposite ends that are receivable in said receptacles, respectively, said inner and outer members having transverse holes that are movable into alignment, said bar assembly also including removable pin means adapted to fit through said holes to maintain a selected length of said bar assembly, the bar system further comprising biasing means connected between the inner and outer members for urging said members to telescope inwardly so as to shorten the length of said bar assembly when the pin is removed, the bar thus being shortened sufficiently to fall free of the receptacles, permitting the door to be opened.

2. A security bar system as defined in claim 1, wherein said inner and outer members are tubular, and each has an interior attachment terminal, and said biasing means is a tension spring engaged at the opposite ends thereof with said terminals, respectively.

3. A security bar system as defined in claim 1, wherein said receptacles have a socket configuration limiting the depth of penetration of the ends of said bar assembly, respectively, and said receptacles provide freedom of angular declination sufficient for said bar assembly to drop free on disengagement of one end thereof from the receptacle associated with said one end.

4. A self-releasing security bar mechanism for barring an inwardly pivoting door mounted on a door jamb, the security bar mechanism comprising a bar assembly suspended between a pair of receptacles mounted on opposite sides of the door jamb on an inward side of a door, the bar assembly comprising a pair of interfitting elongated members that are slidable between an extended position, wherein outer ends of the members engage the receptacles, and a shortened position, wherein the outer ends of the members do not extend all the way between the receptacles, the bar assembly further comprising biasing means interconnecting the bar assembly members and urging them toward said shortened position, the security bar mechanism further including a plurality of alignable transverse openings in the bar assembly members and a removable pin that fits through aligned openings so as to maintain the bar assembly in its extended position, the bar assembly automatically retracting to its shortened position when the pin is manually removed, permitting the bar assembly to fall free of the receptacles and permitting the door to be opened.

5. A self-releasing security bar mechanism according to claim 4 wherein the bar assembly members are telescoping tubular members including an inner member and an outer member, the biasing means comprising a tension spring extending between internal attachment terminals on the inner and outer members, respectively.

6. A self-releasing security bar mechanism according to claim 4 wherein the aligned openings in the bar assembly members are vertically oriented and the pin is removably inserted in the openings from the underside of the bar assembly, such that the pin is removed by pulling the pin in a downward direction, the pin being held in the openings by frictional pressure exerted by the tension spring on the members.

7. A self-releasing security bar mechanism according to claim 4 wherein the receptacles comprise tubular socket members having open inner ends that face each other and having closed outer ends that limit the extent to which the bar can extend into the receptacles, the receptacles having tubular sides that enclose the outer ends of the bar assembly members and restrain the members from inward movement when an attempt is made to open the door, one section of the side of at least one channel member comprising a cover plate that is pivotable inwardly to permit sideways insertion of the bar assembly into the receptacle by pressing the bar assembly inwardly against the cover plate, the cover plate thereafter closing and preventing sideways removal of the bar without collapsing the bar or manually opening the cover plate.

8. A self-releasing security bar mechanism according to claim 6 and further comprising a pull chain that hangs from the pin, the pull chain and downward release of the pin facilitating removal of the pin by a person positioned near the floor.

* * * * *